US010597987B2

(12) United States Patent
Escudero et al.

(10) Patent No.: US 10,597,987 B2
(45) Date of Patent: Mar. 24, 2020

(54) SYSTEM AND METHOD FOR PERFORATING A FORMATION

(71) Applicant: Schlumberger Technology Corporation, Sugar Land, TX (US)

(72) Inventors: Jose Escudero, Pearland, TX (US); Steven W. Henderson, Katy, TX (US); Byron Enrique Rosario Ruiz, Quito (EC); Carlos Baumann, Austin, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 230 days.

(21) Appl. No.: 15/144,305

(22) Filed: May 2, 2016

(65) Prior Publication Data

US 2016/0319646 A1 Nov. 3, 2016

Related U.S. Application Data

(60) Provisional application No. 62/155,290, filed on Apr. 30, 2015.

(51) Int. Cl.
*E21B 43/117* (2006.01)

(52) U.S. Cl.
CPC ..... *E21B 43/117* (2013.01)

(58) Field of Classification Search
CPC ..... E21B 43/117
See application file for complete search history.

(56) References Cited

U.S. PATENT DOCUMENTS 4,478,294 A * 10/1984 Sumner ..... E21B 43/11857 102/200
6,732,798 B2 5/2004 Johnson et al.
7,243,725 B2 * 7/2007 George ..... E21B 43/1195 166/297
7,287,589 B2 10/2007 Grove et al.
7,428,921 B2 9/2008 Grove et al.
7,571,768 B2 * 8/2009 Cuthill ..... E21B 43/1195 166/297
8,006,762 B2 * 8/2011 Burleson ..... E21B 43/1195 166/297
8,302,688 B2 * 11/2012 Burleson ..... E21B 43/1195 166/259
8,622,149 B2 1/2014 Gill et al.
(Continued)

OTHER PUBLICATIONS

Pacific Scientific Energetic Materials Company, www.psemc.com.
PyroAlliance Groupe SNPE, www.pyroalliance.com.

*Primary Examiner* — Giovanna C Wright
*Assistant Examiner* — Jonathan Malikasim
(74) *Attorney, Agent, or Firm* — Cameron R. Sneddon

(57) ABSTRACT

A technique facilitates formation of perforations into a formation surrounding a borehole in a manner which enhances fluid flow along the perforations. The technique comprises providing a plurality of perforating charges which may be detonated in the borehole to create perforations. The detonation is used to initiate a time delay device for controlling a subsequent detonation of a corresponding charge. The corresponding charge is used to create a pressure underbalance in the borehole. This relatively lower pressure in the borehole is selectively established to create a reverse flow through the perforations which cleans the perforations.

19 Claims, 7 Drawing Sheets

(56) References Cited

U.S. PATENT DOCUMENTS

| | | | | |
|---|---|---|---|---|
| 8,807,003 | B2 * | 8/2014 | Le | E21B 43/1195 102/310 |
| 8,991,496 | B2 * | 3/2015 | Bishop | E21B 43/11852 166/298 |
| 2016/0245035 | A1 * | 8/2016 | Brady | E21B 43/116 |

* cited by examiner

SYSTEM AND METHOD FOR PERFORATING A FORMATION

CROSS-REFERENCE TO RELATED APPLICATION

The present document is based on and claims priority to U.S. Provisional Application Ser. No. 62/155,290, filed Apr. 30, 2015, which is incorporated herein by reference in its entirety.

BACKGROUND

To complete a well, at least one formation zone may be perforated to allow fluid to flow from the formation into the well for production or to flow out of the well during injection into the surrounding formation zone or zones. A perforating gun string may be lowered into the well along a casing lined wellbore until positioned adjacent a desired formation zone. The perforating guns of the gun string may then be fired to create openings through the casing and to extend these perforations into the surrounding formation.

The explosive nature of the perforating operation tends to shatter sand grains of the formation during creation of perforation tunnels. Consequently, a shock damaged region may be created around the perforation tunnels and this region has a lower permeability than that of the original formation matrix. The perforating operation also may generate perforation tunnels full of debris, e.g. rock debris mixed with perforator charge debris. The extent of the damage and the amount of loose debris in the tunnel is dictated by a variety of factors, such as formation properties, explosive charge properties, pressure conditions, fluid properties, and/or other factors. The shock damaged region and the loose debris in the perforation tunnels can impair the productivity of production wells or the injectivity of injector wells.

SUMMARY

In general, a system and methodology facilitate formation of perforations into a formation surrounding a borehole in a manner which enhances fluid flow along the perforations. The technique comprises providing a plurality of perforating charges which may be detonated in the borehole to create perforations. The detonation is used to initiate a time delay device for controlling a subsequent ignition of a corresponding charge. The corresponding charge is used to create a pressure underbalance in the borehole. This relatively lower pressure in the borehole is selectively established to create a reverse flow through the perforations which cleans the perforations.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate formation of perforations with improved fluid flow characteristics. The perforations are formed into a formation surrounding a borehole via a plurality of perforating charges which may be detonated in the borehole to create the outwardly extending perforations. Upon detonation, a time delay device is initiated to provide a desired period of time before a subsequent ignition of a corresponding charge. By way of example, the time delay device may be a time delay fuse or other device initiated via detonation of the perforating charges.

The corresponding charge acts as an underbalance charge and is used to create a pressure underbalance in the borehole. The pressure underbalance refers to the creation of a pressure differential having a lower pressure in the borehole relative to a higher pressure in the surrounding formation. This relatively lower pressure in the borehole is selectively established to create a reverse flow through the perforations which cleans the perforations. When the wellbore pressure is lower than the formation pressure, well fluid naturally flows from the formation into the wellbore as the pressure equalizes. This fluid flow carries some of the damaged rock debris particles and charge debris particles out of the perforations and into the wellbore, thus cleaning the perforation tunnels and sometimes reducing the damage to the perforation tunnels.

In some applications, the formation also may be fractured. In fact, fracturing of the formation can be used to bypass the damaged and plugged perforations, e.g. perforation tunnels. However, the cleaned perforations facilitate the fracturing operation by enabling a low fracture initiation pressure. The low fracture initiation pressure helps ensure performance of a good quality fracturing job. Although the cleaning action of the reverse flow can help reduce damage to the perforation tunnels, additional treatment techniques, e.g. acidizing techniques, can sometimes be used to further remove perforation shock damage.

Figure 1:
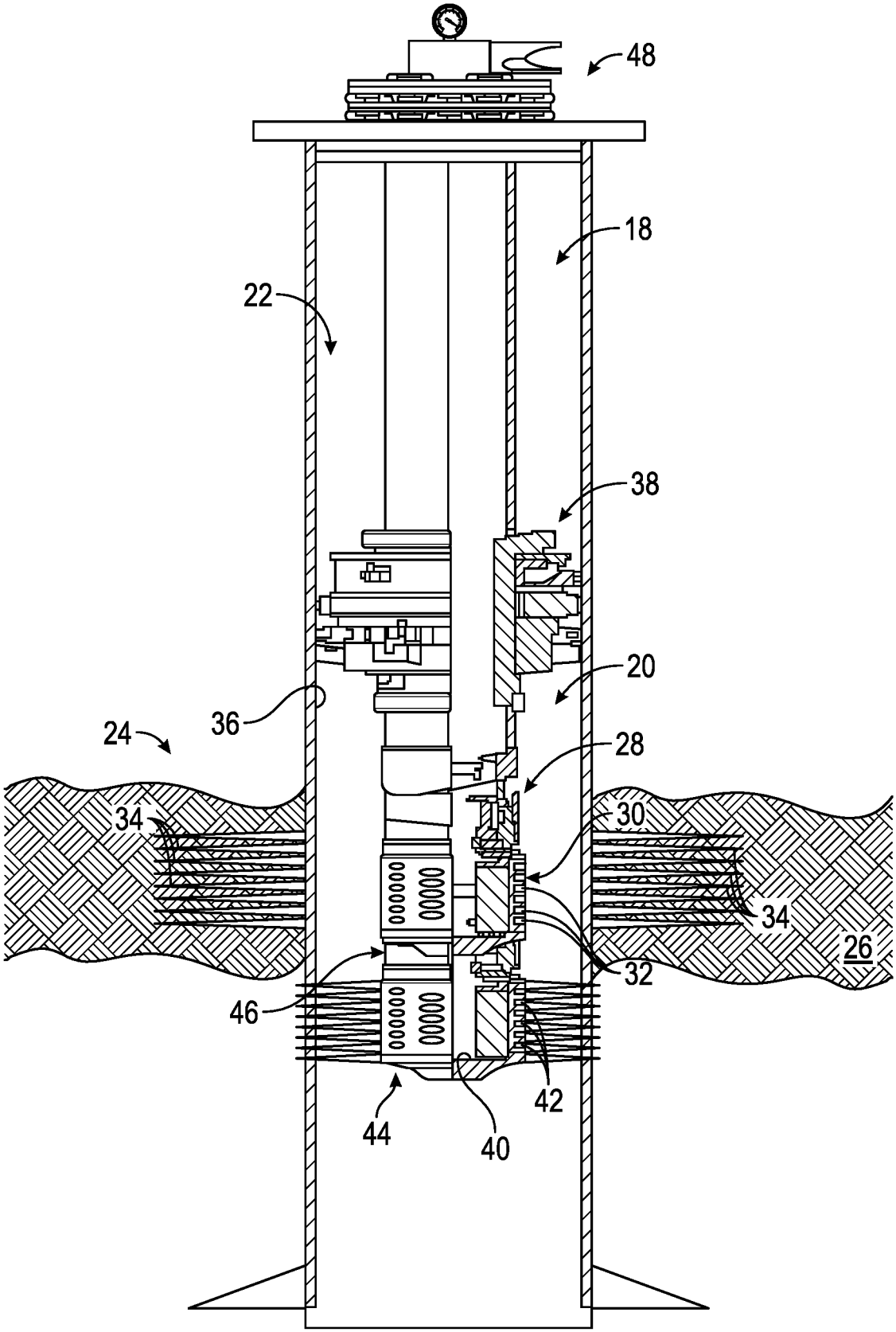
FIG. 1 is an illustration of an example of a gun string positioned in a borehole, e.g. a wellbore, according to an embodiment of the disclosure.

Referring generally to FIG. 1, an example of a well string 18 is illustrated. The well string 18 may be in the form of or may comprise a gun string 20 sized for deployment downhole into a borehole 22 of, for example, a well 24. In well applications, the borehole 22 may be a wellbore drilled into a formation 26 containing desirable production fluids, such as oil and/or natural gas. However, the gun string 20 may be deployed in a variety of other types of boreholes 24 for use in other types of applications. Depending on the application, gun string 20 may be the entire well string or it may be coupled to another string. For example, gun string 20 may be attached to or part of an overall temporal or permanent completion string.

The gun string 20 comprises a downhole tool 28 having a perforating gun 30 comprising a plurality of charges 32, e.g. shaped charges. The charges 32 are oriented to form perforations 34 into the formation 26 upon detonation. For example, the charges 32 may be shaped charges oriented in a radially outward direction to form perforations 34 in the form of perforation tunnels which extend generally radially outward into the formation 26. In a variety of applications, the borehole 24 may be lined with a casing 36. In such an embodiment, the detonation of charges 32 effectively pierces the casing 36 such that the perforations 32 extend through the casing 34 and into the formation 26. In some embodiments, the charges 32 may be detonated with the aid of a firing head 37.

In the embodiment illustrated, the downhole tool 28 of gun string 20 is disposed downhole, e.g. beneath, a packer 38. The packer 38 may be selectively actuated to form a seal between the gun string 20 and the surrounding well casing 36 during, for example, detonation of shaped charges 32. In this example, the gun string 20 further comprises a chamber 40 having at least one charge 42 and often a plurality of charges 42. The at least one charge 42 may be selectively ignited/detonated to create an underbalance pressure in the borehole 22 downhole of packer 38. The underbalance pressure is sufficient to create a reverse flow of fluid through perforations 34 and into the portion of borehole 22 downhole from, e.g. below, packer 38 to thus clean debris from perforations 34 after detonation of perforating charges 32. In some applications, the chamber 40 and the charge or charges 42 may be part of a second gun 44. Depending on the application, the second gun 44 may be solely an underbalance gun, a combination underbalance and perforating gun, or a perforating gun constructed to create an underbalance pressure. It should be noted that other perforating applications may utilize other types of packers or may be performed without the illustrated packer 38.

The gun string 20 further comprises a time delay device 46, e.g. a time delay fuse, operatively coupled between the plurality of charges 32 and the at least one corresponding charge 42 of chamber 40. In the example illustrated, the time delay device 46 is automatically initiated upon detonation of charges 32 and then causes ignition of the at least one charge 42 upon expiration of a predetermined period of time. As a result, the desired underbalance pressure cleaning perforations 34 is automatically established at a predetermined time period after formation of perforations 34.

In some embodiments, the time delay device 46 is a time delay fuse which may be positioned between the first/perforating gun 30 and the second gun 44 so that detonation of charges 32 ignites the time delay fuse. The time delay fuse then burns until automatically detonating the corresponding, underbalance generating charges 42. In various embodiments described herein, the perforating gun 30 and the second gun 44 (used to create the underbalance pressure) are spaced from each other longitudinally along gun string 20. Similarly, the chamber 40 may be spaced longitudinally from perforating gun 30.

The downhole tool 28 may be constructed with various configurations depending on the parameters of a given perforating operation and/or perforating environment. Depending on the embodiment, the guns 30, 44 may be various combinations and/or mixtures of perforating guns and underbalance guns. Underbalance guns may have charges sized to avoid formation of perforations in the surrounding formation while creating a desired transient local pressure condition upon detonation. The transient local pressure is a pressure sufficiently lower than the pressure of the surrounding formation to promote debris removal from the tunnels formed by perforations 34.

According to an embodiment, the second gun 44 may be an underbalance gun having one or more shaped charges 42 sized to perforate the housing or carrier of the second gun 44, thus creating the local underbalance pressure. In this embodiment, however, the charges 42 are not able to perforate the casing 36 or formation 26. In some embodiments, the second gun 44 may include a combination of formation perforating charges interspersed with underbalance generating charges which do not perforate the casing 36. According to other embodiments, the second gun 44 may include formation penetrating charges having substantial spacing between at least some of these charges 42.

In this latter embodiment, the spacing between charges 42 is selected to enable creation of an underbalance condition between the interior of the gun housing and the formation via holes in the gun housing resulting from detonation of the charges 42. The spacing also may be sufficiently large along the length of the gun string 20, e.g. along second gun 44, so that the interior volume of the housing between holes resulting from detonation of the charges is relatively large. The large size ensures that enough fluid is able to enter through the interior of the gun 44 through the holes so as to enable cleanout of the perforations 34.

Referring again to FIG. 1, the gun string 20 is located downhole in borehole 22 beneath surface equipment 48, e.g. a rig or other equipment for deploying the gun string. In this example, perforating gun 30 is disposed at a spaced distance uphole from, e.g. above, the second gun 44 which is an underbalance gun. When the perforating gun 30 is detonated, shaped charges 32 explode and form perforations 34 through casing 36 and into formation 26. The detonation also activates the time delay device 46, e.g. time delay fuse, which automatically causes the at least one charge 42 of second gun 44 to detonate after the desired time delay.

The period of time/delay provided by the time delay device 46 allows transient pressure in the wellbore 22 to defuse or disappear after perforating gun 30 detonates. Once the transient pressure waves generated by the perforating gun 30 have subsided, the time delay device 46 ignites, e.g. detonates, the charge(s) 42 of second gun 44. Detonation of the second gun 44 creates the underbalance pressure condition within the portion of wellbore 22 downhole of, e.g. beneath, packer 38.

In this example, the second gun 44 has not been moved during the period of time afforded by time delay device 46. However, the delay provided by time delay device 46 has allowed the wellbore pressure to stabilize. Consequently, the perforations 34 created by detonation of perforating gun 30 are subsequently subjected to the underbalance pressure resulting from detonation of charge(s) 42 of second gun 44. Without the time delay, the pressure effects caused by detonation of the first gun 30 would negate or at least reduce the underbalanced pressure effect created by detonation of second gun 44.

Figure 2:
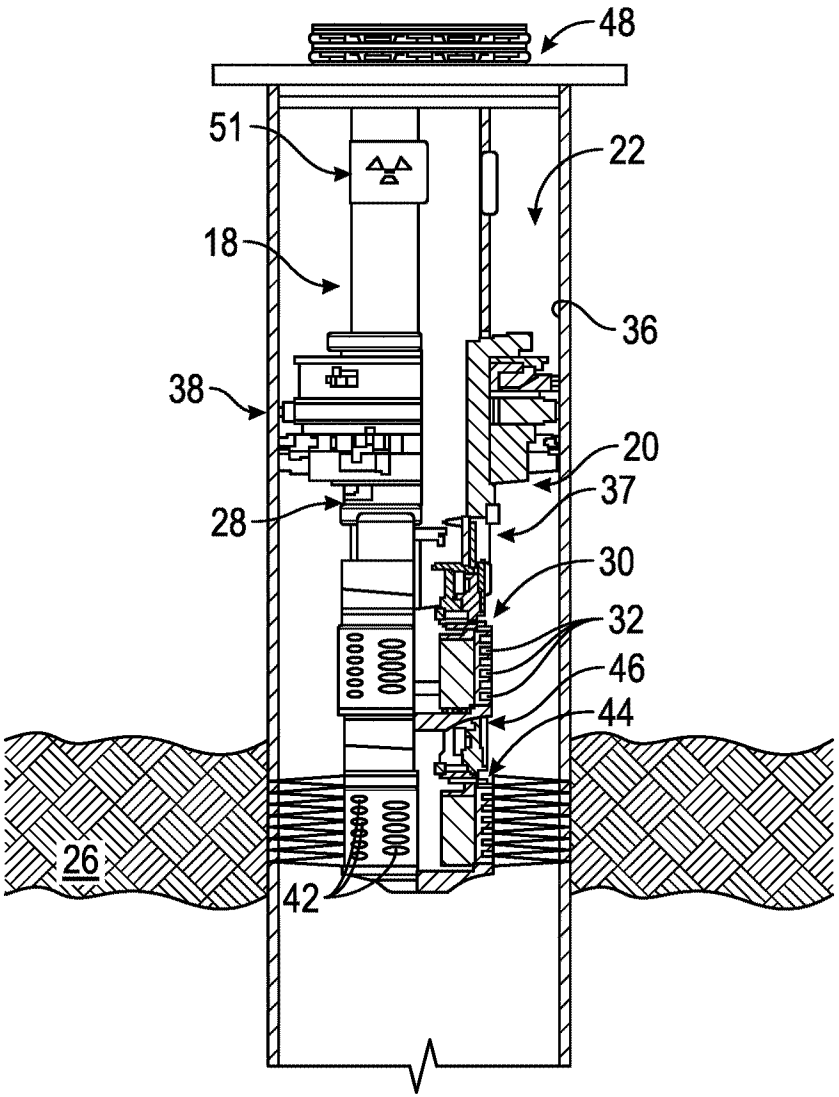
FIG. 2 is an illustration of an example of a gun string positioned in a wellbore at a first operational position and then moved to a second operational position, according to an embodiment of the disclosure.
Figure 2:
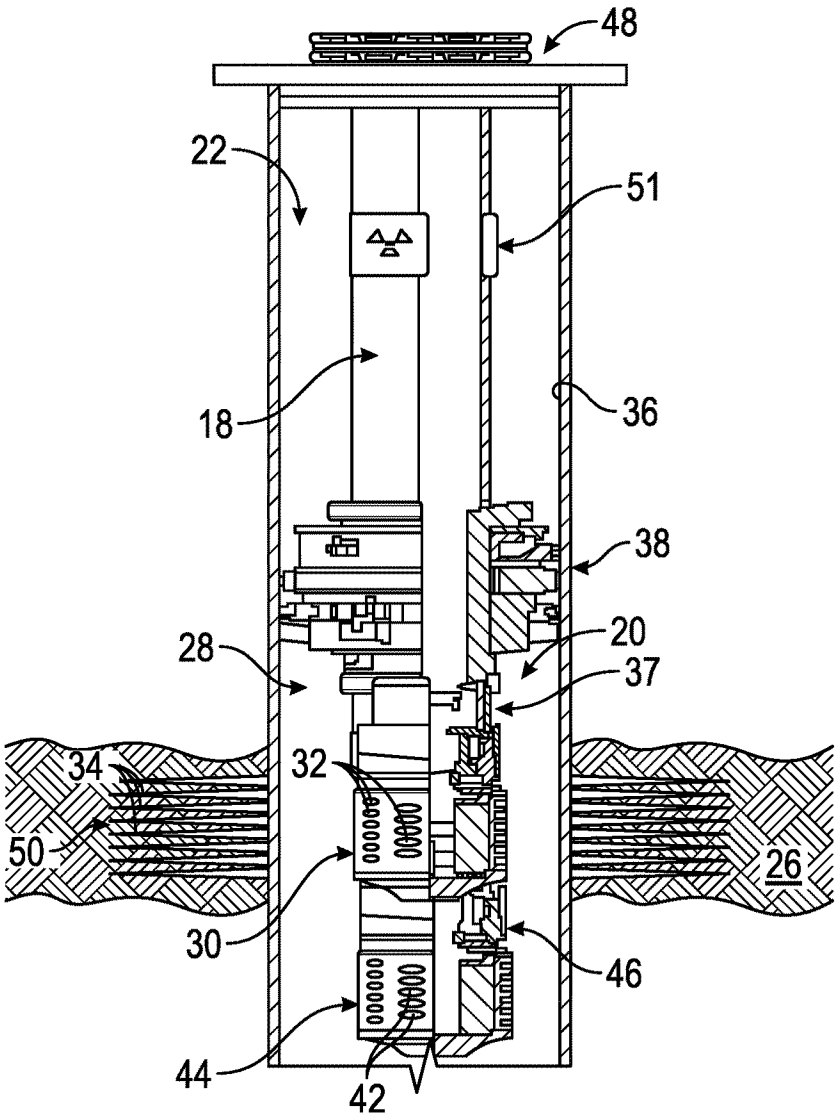

Referring generally to FIG. 2, another embodiment is illustrated in which gun string 20 and downhole tool 28 are in a first operational position (left side) and a second operational position (right side). In this example, the downhole tool 28 is moved down into borehole 22 until perforating gun 30 is adjacent a desired section 50 of formation 26. The shaped charges 32 of perforating gun 30 are then detonated to perforate formation section 50 with perforations 34. In some applications, the gun string 20 also may comprise other features such as a radioactive source 51.

The detonation also serves to initiate, e.g. activate, the time delay device 46, thus creating the desired period of time prior to detonation of the at least one charge 42 of second gun 44. During this delay period, the gun string 20, including downhole tool 28, is moved to another position along wellbore 22. For example, the downhole tool 28 may be raised to a position such that the second gun 44 is at or near the now perforated section 50 of formation 26. The time delay device 46 then causes the second gun 44 to detonate at this second wellbore location proximate section 50, as illustrated on the right side of FIG. 2.

In this embodiment, the second gun 44 may be an underbalance gun with a plurality of the charges 42 sized to avoid further perforation of formation section 50 upon detonation. However, detonation of underbalance charges 42 removes damaged material from the formation zone around the perforation tunnels 34 while also removing debris from inside the perforations 34 by creating the pressure underbalance. As with embodiments described above, detonation of charges 42 generates a pressure underbalance condition. The pressure underbalance condition is created in the portion of wellbore 22 which is downhole from, e.g. beneath, packer 38 and causes the higher formation pressure to force fluid flow into the wellbore 22 along the perforations 34. The fluid flow along perforations 34 carries debris from perforations 34 and into the wellbore 22 through the perforation holes formed in casing 36, thus cleaning the perforations.

Figure 3:
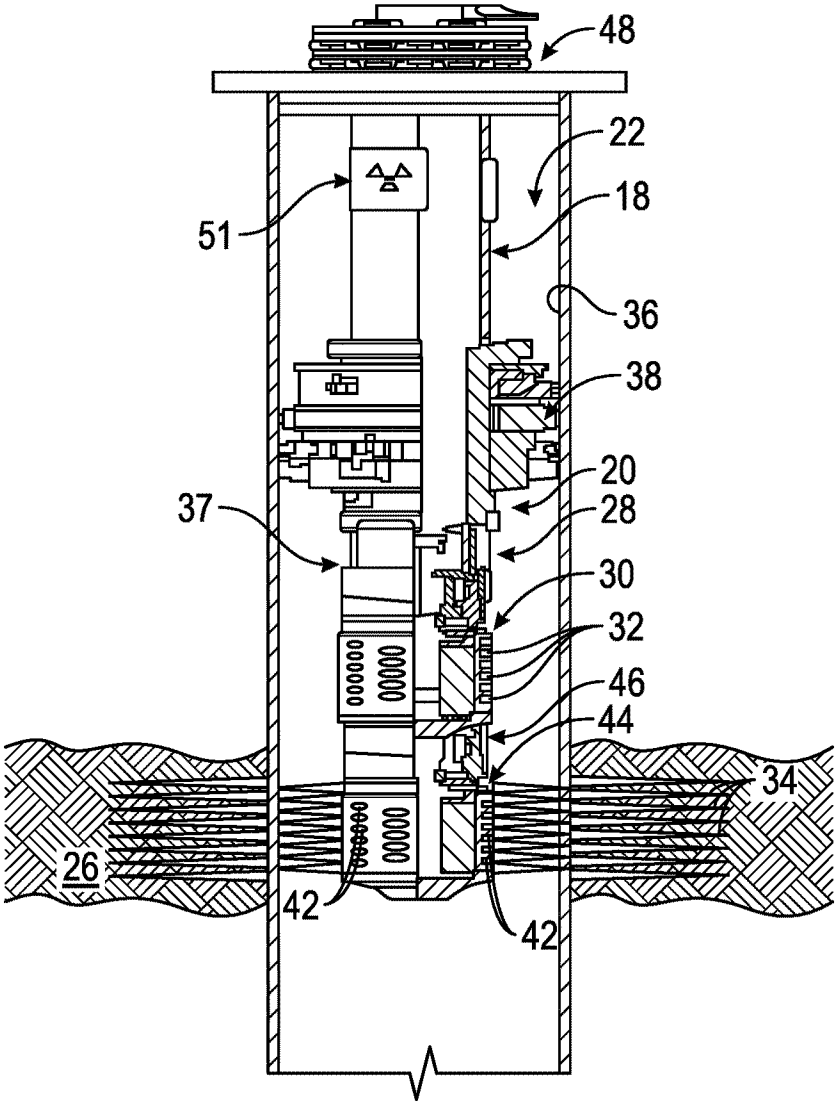
FIG. 3 is an illustration of another example of a gun string positioned in a wellbore at a first operational position and then moved to a second operational position, according to an embodiment of the disclosure.
Figure 3:
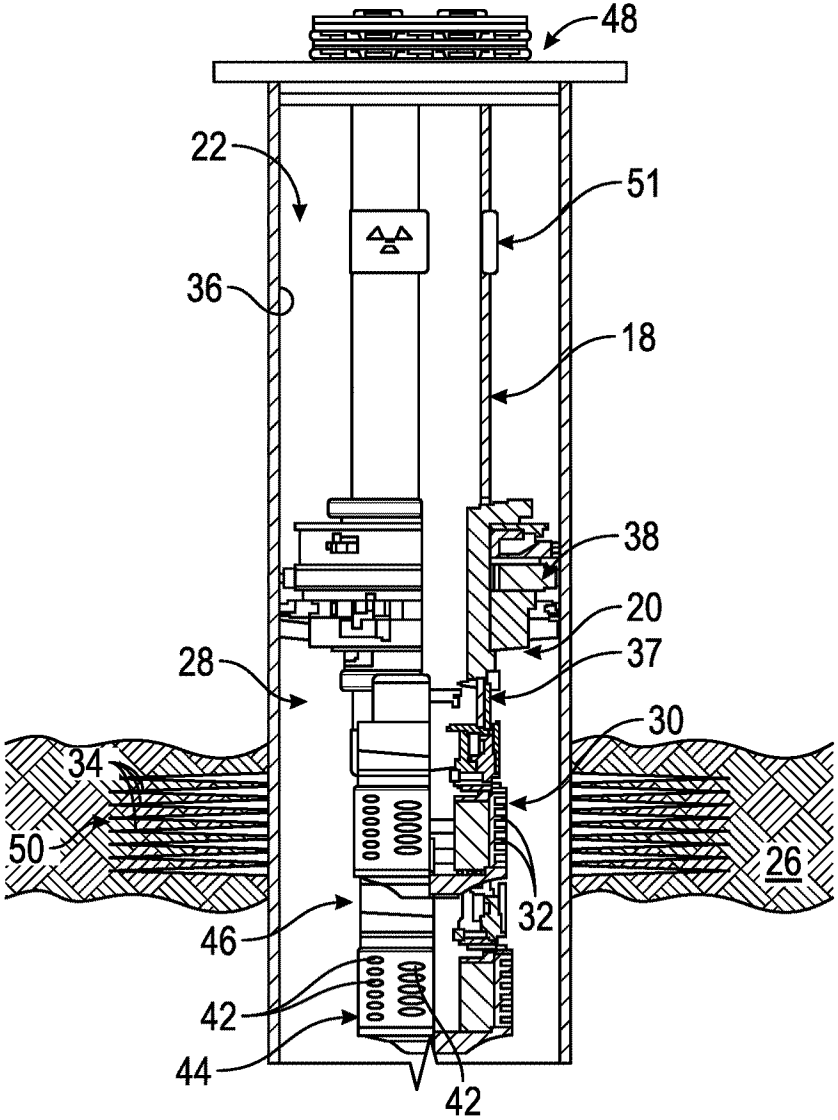

Referring generally to FIG. 3, another embodiment is illustrated in which gun string 20 and downhole tool 28 are in a first operational position (left side) and a second operational position (right side). In this example, the downhole tool 28 is moved down into borehole 22 until perforating gun 30 is adjacent the desired section 50 of formation 26. The shaped charges 32 of perforating gun 30 are then detonated to perforate formation section 50 with perforations 34, as illustrated on the left side of FIG. 3.

The detonation again serves to initiate the time delay device 46 to establish the desired period of time prior to detonation of the at least one charge 42 of second gun 44. During this delay period, the gun string 20, including downhole tool 28, is moved to another position along wellbore 22. As with the previous embodiment, the downhole tool 28 may be raised to a position such that the second gun 44 is at or near the now perforated section 50 of formation 26. The time delay device 46 then causes the second gun 44 to detonate at this second wellbore location proximate section 50, as illustrated on the right side of FIG. 3.

In this embodiment, the second gun 44 may be an underbalance gun which also includes formation perforating charges to further perforate section 50 of formation 26. For example, the second gun 44 may have a mixture of perforating shaped charges 32 and underbalance charges 42. The perforating charges 32 create additional perforation tunnels 34 while the underbalance charges 42 create the desired low-pressure, underbalance condition which promotes debris removal from the tunnels formed by perforations 34.

Figure 4:
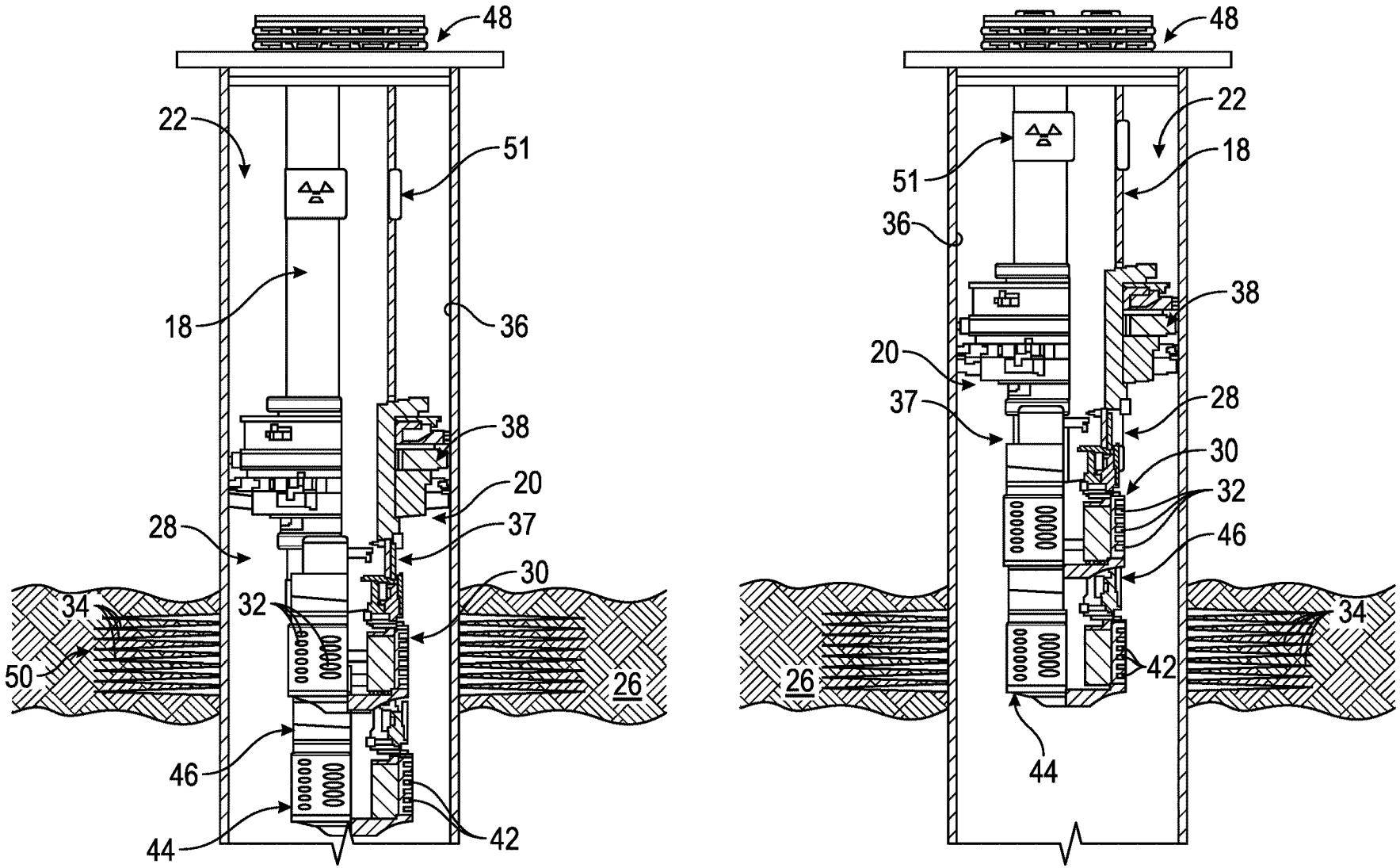
FIG. 4 is an illustration of another example of a gun string positioned in a wellbore at a first operational position and then moved to a second operational position, according to an embodiment of the disclosure.

Referring generally to FIG. 4, another embodiment is illustrated in which gun string 20 and downhole tool 28 are in a first operational position (left side) and a second operational position (right side). In this example, the downhole tool 28 is moved down into borehole 22 until perforating gun 30 is adjacent the desired section 50 of formation 26. The shaped charges 32 of perforating gun 30 are then detonated to perforate formation section 50 with perforations 34, as illustrated on the left side of FIG. 4.

The detonation again serves to initiate the time delay device 46, thus creating the desired period of time prior to detonation of the second gun 44. During this delay period, the gun string 20, including downhole tool 28, is moved to another position along wellbore 22. As with the previous embodiment, the downhole tool 28 may be raised to a position such that the second gun 44 is at or near the now perforated section 50 of formation 26. The time delay device 46 then causes the second gun 44 to detonate at this second wellbore location proximate section 50, as illustrated on the right side of FIG. 4.

In this embodiment, the second gun 44 also serves as a perforating gun and comprises charges 32 sized and oriented to create additional perforations 34. In some applications, the detonation of second gun 44 may be used to simply create additional perforations. However, the charges 32 in second gun 44 also may be arranged, e.g. spaced, in a manner which causes an underbalance condition for promotion of perforation tunnels cleaning.

Figure 5:
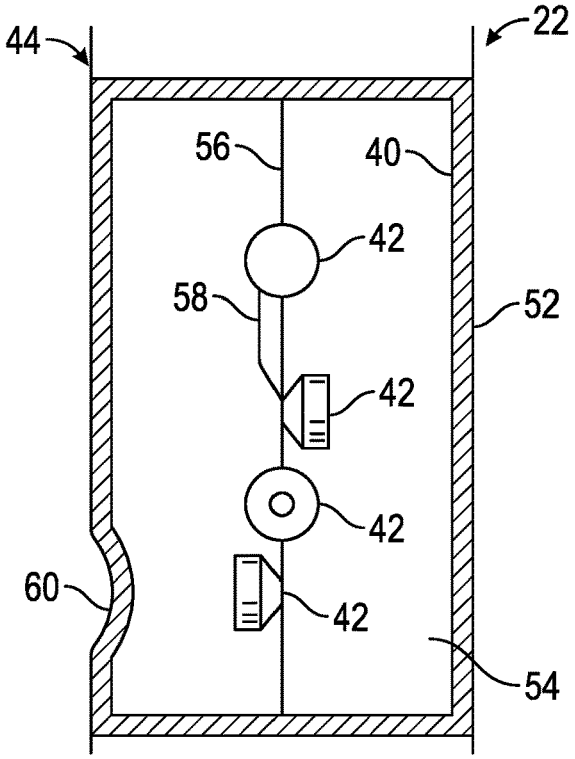
FIG. 5 is a schematic illustration of an example of a chamber containing a corresponding, underbalance charge to enable creation of a pressure underbalance within a borehole, according to an embodiment of the disclosure.

Referring generally to FIG. 5, an embodiment of second gun 44 is illustrated in the form of an underbalance gun. The underbalance gun 44 comprises a surrounding housing 52 which creates chamber 40 sealed from the surrounding environment of borehole 22. It should be noted the chamber 40 and housing 52 may be part of other gun string devices. However, the illustrated embodiment shows chamber 40 positioned at a suitable location along the second gun 44. In some applications, the housing 52 may be the primary gun housing of second gun 44.

In this example, charges 42 are disposed within housing 52 and may be in the form of shaped charges. However, the charges 42 serve as underbalance or surge charges which create the desired pressure underbalance condition upon detonation. In the illustrated embodiment, the charges 42 penetrate through the wall of housing 52 to expose the interior of chamber 40 to the surrounding formation pressure experienced in borehole 22 due to perforations 34 extending into formation 26.

As illustrated, the housing 52 forms chamber 40 which may comprise a surge chamber sealed from the wellbore environment until it is desired to create a pressure change in the portion of wellbore 22 downhole from packer 38. In some applications, surge chamber 40 is filled with a selected fluid 54. One or more of the surge charges 42 is disposed within surge chamber 40 and may be carried by, for example, a loading tube 56. By way of example, the charges 42 may be detonated by an initiator line 58 which may be part of the time delay device 46. Depending on the application, the initiator line 58 may comprise a detonating cord, an electrical line, a fiber optic line, or another suitable line able to initiate detonation of charges 42. In this embodiment, the charges 42 are shaped charges sized to penetrate the wall of housing 52 without penetrating casing 36 and without damaging other well equipment outside of housing 52. Thus, the charges 42 are able to generate the desired pressure underbalance without penetrating the casing 36 or the surrounding formation 26.

The surge chamber 40 is provided with an inner pressure which is lower than the expected formation pressure in the wellbore 22 at the depth of formation section 50 to be treated. By way of example, the surge chamber 40 may be filled with the fluid 54, e.g. air, nitrogen, or other suitable fluid. When the charges 42 are detonated, the wall forming housing 52 is perforated and this opens surge chamber 40 to the surrounding wellbore 22. Fluid from the wellbore 22 flows into surge chamber 40 and creates a substantially instantaneous underbalance condition in the wellbore. The underbalance condition creates the relatively lower pressure compared to formation pressure and causes fluid flow through the perforations 34 toward wellbore 22. The fluid flow, in turn, cleans debris from the perforations 34 and improves otherwise damaged regions of the tunnels forming perforations 34.

In some embodiments, the housing 52 may include a recess portion 60 positioned on the surface of housing 52 and disposed outwardly of at least one of the shaped charges 42. The recess portion 60 may be constructed so as to break away when the corresponding charge 42 detonates, thus creating a larger hole through the wall forming housing 52. In some applications, more than one recess portion 60 may be used at desired positions along housing 52.

Figure 6:
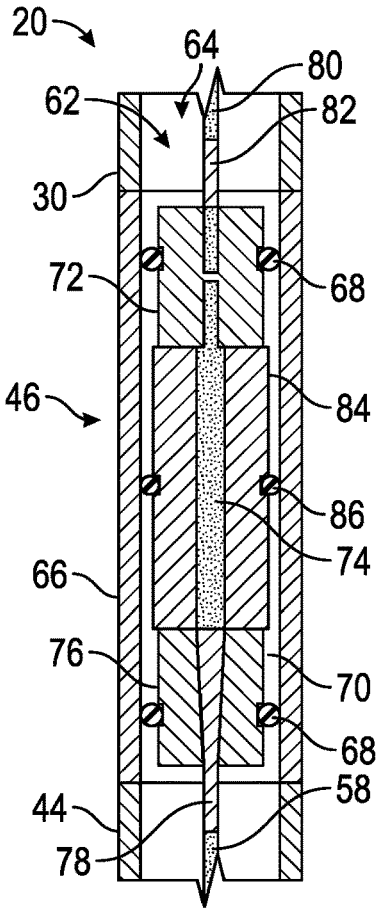
FIG. 6 is an illustration of an example of a time delay device which may be used to delay ignition of the corresponding, underbalance charge after detonation of perforating charges, according to an embodiment of the disclosure.

Referring generally to FIG. 6, an embodiment of time delay device 46 is illustrated. In this embodiment, the time delay device 46 comprises a time delay fuse 62 which is operable to provide a delay between firing of the first gun 30 and the second gun 44. The period of time provided by the delay is sufficient to promote cleanout of the perforations 34 formed by the first gun 30 and/or second gun 44. Depending on the application, the period of time provided by the delay may be at least 0.1 seconds, at least 0.5 seconds, at least 1.0 seconds, at least 2.0 seconds, at least 5.0 seconds, or a greater period of time. In some applications, for example, the time delay fuse 62 may establish a multi-minute (e.g. 6 minute) time delay to facilitate movement of the gun string 20 and/or other actions. A selected number of the time delay fuses 62 may be coupled together, e.g. operatively stacked together, to establish a desired length of the predetermined time period. Additionally, the time delay fuse 62 may comprise hydraulic, electrical, and/or pyrotechnic fuses. An example of a time delay fuse 62 which may be incorporated into the gun string 20 is described in U.S. Pat. No. 8,622,149.

In the embodiment illustrated in FIG. 6, the time delay fuse 62 is a pyrotechnic time delay fuse positioned in a ballistic train 64 in downhole tool 28 of gun string 20. In this embodiment, the time delay fuse 62 is disposed in a fuse housing 66 which may be part of the gun carrier and/or loading tube of at least one of the adjacent guns 30 or 44. A fluid/pressure seal 68, e.g. O-rings, may be provided across an annulus 70 between housing 66 and the ballistic train 64. A pressure barrier may be maintained via seal 68 after initiation, e.g. ignition, of the time delay fuse 62.

The illustrated example of time delay fuse 62 comprises at least three different explosive devices with no hydraulic pistons, firing pins, or pressure activation elements. By way of example, the three different explosive devices comprise a through-bulkhead initiator 72, a delay pyrotechnic charge 74 (e.g. a fuse and/or time delay mix), and an output booster 76 (e.g. a deflagration to detonation initiator). The initiator 72 isolates the delay charge 74 and the second explosive device, e.g. charges in second gun 44, from pressures above due to detonation of a first explosive device, e.g. charges in perforating gun 30. Suitable through-bulkhead initiators 72 may be obtained from, for example, Specific Scientific Energetic Materials Company and PyroAlliance Groupe SNPE.

The delay charge 74 burns at a predetermined rate which provides the period of time delay between detonation of the charges 32 in first gun 30 and detonation of charges 42 in second gun 44. The deflagration to detonation booster device 76 transfers the burn energy of delay charge 74 back to detonation and initiates the second explosive device, e.g. charges 42 of second gun 44, via ignition of an input booster 78.

In the embodiment illustrated, time delay fuse 62 does not use a hydraulic mechanism, a percussion initiator, or a mechanical percussion detonator. Elimination of mechanical initiation devices and initiation pressure responsive mechanisms in the time delay device 46 reduces the chance for inadvertent actuation. Because time delay fuse 62 is ballistically initiated, the associated explosive devices, e.g. charges 32 and charges 42, do not fire out of sequence or unpredictably. This type of time delay fuse 62 does not have moving parts and is initiated by an explosion such as the detonation of charges 32 of first gun 30.

During a perforating and cleaning operation, the gun string 20 is deployed downhole into borehole 22 to a desired location for forming perforations 34. A detonating cord 80 may be used in cooperation with, for example, firing head 37, to cause detonation of charges 32 in the first gun 30. A ballistic transfer from the end of the first gun 30 to the time delay fuse 62 is then achieved via a booster to booster transfer. For example, detonation of charges 32 initiates an input booster 82 of the through-bulkhead initiator 72. The initiator 72 facilitates a ballistic transfer without damaging the pressure barrier 68 which isolates the first gun 30 from the delay charge 74 and from second gun 44. Furthermore, the initiator 72 initiates delay charge 74. Depending on the application, the time delay fuse 62 also may comprise other components to facilitate reliable time delay. For example, the delay charge 74 may be surrounded by a suitable housing 84 which is sealed with respect to outer housing 66 via a seal member 86.

Upon expiration of the ballistic transfer time delay, output booster 76 transfers the energy of delay charge 74 to the input booster 78 of second gun 44. The input booster 78 is able to ballistically initiate second gun 44 by detonating charges 42. Detonation of charges 42 creates the under balance pressure (and/or perforations) as described above.

The time delay fuse 62 serves as a ballistic transfer delay device which is initiated by detonation. As a result, the time delay fuse 62 cannot be prematurely detonated without an adjacent explosive device being detonated and a high order of ballistic transfer taking place between the explosive device, e.g. first gun 30, and the initiator 72 and delay charge 74. Similarly, the charges 42 of second gun 44 cannot be initiated without the first gun 30 being detonated adjacent time delay fuse 62 accompanied by a high order of ballistic transfer. The high order of ballistic transfer is a booster to booster transfer taking place sequentially between first gun 30, initiator 72, delay charge 74, output booster 76, and input booster 78. A single ballistic transfer delay device such as time delay fuse 62 may be constructed to provide a predetermined period of time delay. By way of example, the desired delay may be a period of time of one second, two seconds, three seconds, four seconds, five seconds, six seconds, or other appropriate numbers of seconds (or minutes) selected for a given perforating and cleaning operation. The period of time may be selected to accommodate movement of the gun string 20 between first and second positions as illustrated in FIGS. 2-4.

Figure 7:
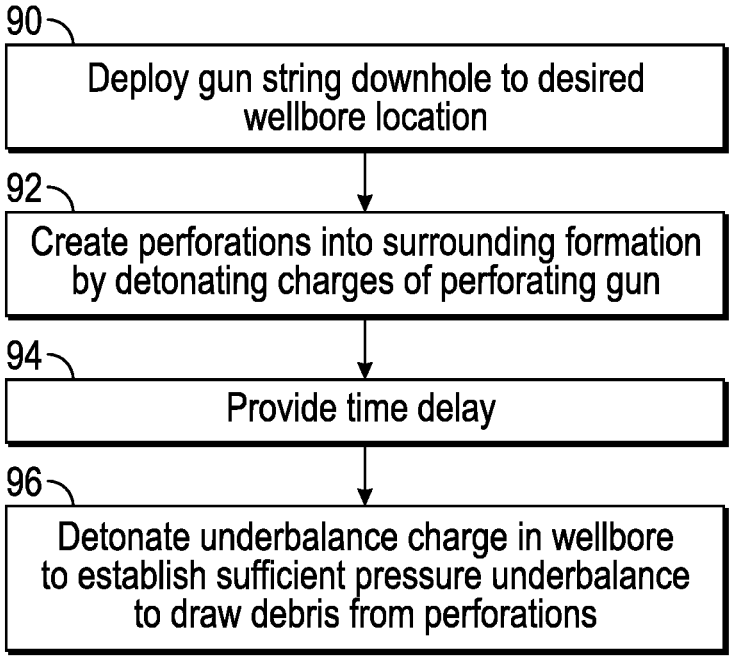
FIG. 7 is a flowchart illustrating an example of a methodology for carrying out the perforating operation, according to an embodiment of the disclosure.

An example of a methodology for perforating and cleaning utilizing gun string 20 is illustrated in the flowchart of FIG. 7. In this example, gun string 20 is initially deployed downhole into wellbore 22 to a desired location along the surrounding formation 26, as illustrated by block 90. The charges 32 of the first/perforating gun 30 are then detonated to create perforations 34 into the surrounding formation, as represented by block 92. The detonation initiates time delay device 46 which provides a desired time delay, as represented by block 94. Upon expiration of the time delay, the at least one charge 42, e.g. underbalance charge, is automatically detonated via the time delay device 46 to create a sufficient underbalance pressure which draws debris out of the perforations 34, as represented by block 96.

Figure 8:
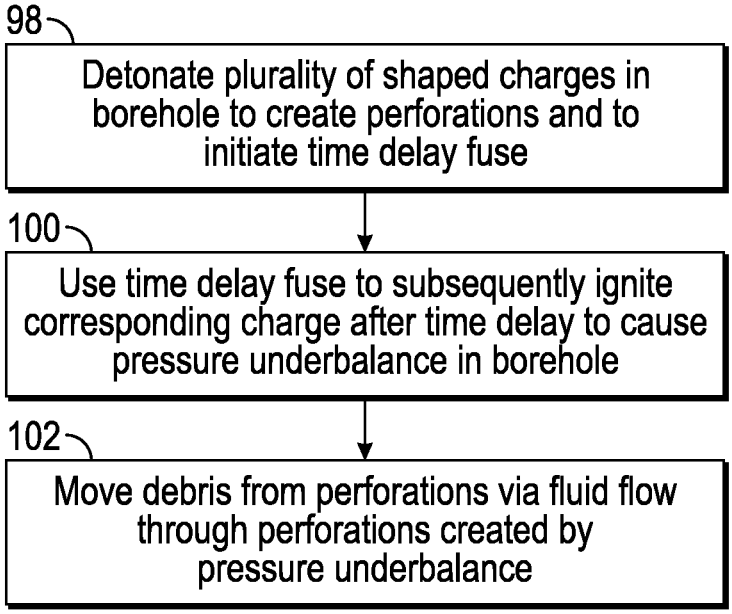
FIG. 8 is a flowchart illustrating another example of a methodology for carrying out the perforating operation, according to an embodiment of the disclosure.

Another embodiment of the methodology is illustrated in the flowchart of FIG. 8. In this example, a plurality of shaped charges 32 is detonated in borehole 22 to create perforations 34 and to initiate time delay fuse 62, as represented by block 98. The time delay fuse 62 is used to subsequently ignite and detonate a corresponding charge which causes a pressure underbalance in the borehole 22 downhole of packer 38, as represented by block 100. The time delay may be predetermined according to the parameters of the specific operation. Detonation of the corresponding charge and the resulting pressure underbalance effectively pulls debris from the perforations 34 to clean the perforations, as represented by block 102. In some applications, the gun string 20 is moved between first and second locations during the time delay.

In some applications, a plurality of time delay devices 46 may be used between a series of perforating guns 30. For example, long interval perforating utilizes a long gun string 20 having several perforating guns 30. In conventional systems, the perforating guns are fired simultaneously and then fill with fluid simultaneously. However, the sudden action of gun firing creates a shockwave that can damage downhole components, e.g. plugs, packers, and/or attached tubing. As the perforating guns filled with fluid following firing, the simultaneous filling also can provide shocks to the system which can cause additional damage to downhole components. However, the time delay devices 46 can be used between perforating guns 30 to cause sequential firing with a predetermined period of time between each sequential firing of each sequential perforating gun 30.

The delay between firing of the perforating guns 30 minimizes the shock and damage that would otherwise result from the simultaneous firing and filling of the perforating guns. Effectively, the cumulative effects of the simultaneous firing are minimized. The time delay devices 46 may be in the form of time delay fuses 62 which automatically are initiated and automatically provide a time delay between sequential firings. In this latter embodiment, the time delay fuses 62 may again use through-bulkhead initiators 72 so as to maintain a pressure barrier for a period of time as described above.

Figure 9:
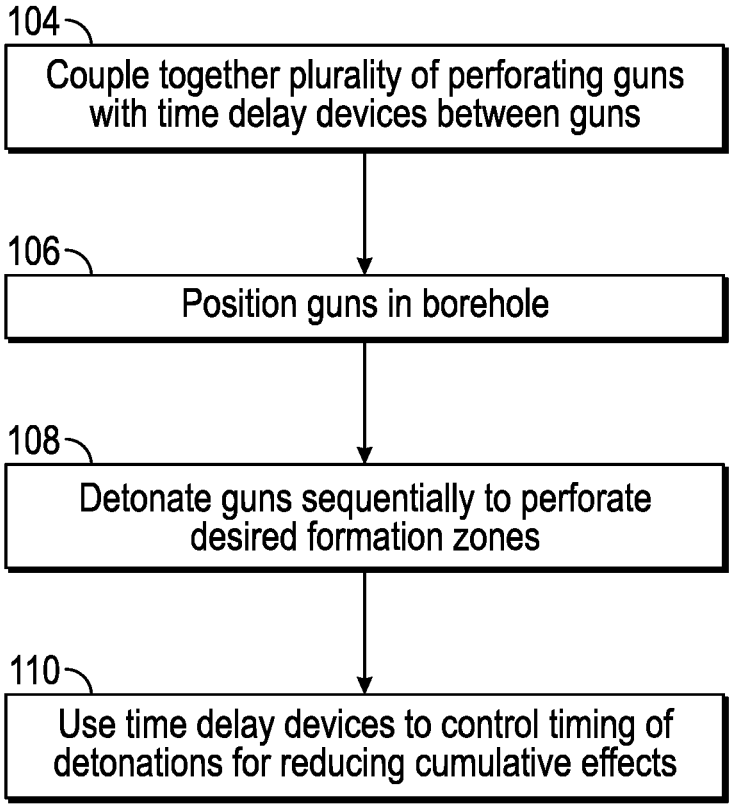
FIG. 9 is a flowchart illustrating another example of a methodology for carrying out the perforating operation, according to an embodiment of the disclosure.

Referring generally to the flowchart of FIG. 9, an embodiment of the methodology of sequential firing is illustrated. In this example, a plurality of perforating guns 30 may be coupled together with a time delay device 46, e.g. time delay fuse 62, coupled between each sequential pair of perforating guns 30, as represented by block 104. The perforating guns 30 are then positioned at desired zones along borehole 22, as represented by block 106. Subsequently, the perforating guns 30 are detonated sequentially to perforate the desired formation zones, as represented by block 108. The time delay devices 46 are configured to control the timing in a manner which reduces cumulative shockwave effects, as represented by block 110. Consequently, long interval perforating operations may be performed with substantially lower risk of damage to downhole components.

Depending on the parameters of a given application and/or environment, the structure of gun string 20 may be adjusted. For example, the gun string 20 may comprise other and/or additional components suited for a given application. Similarly, the first gun 30 and second gun 44 may have a variety of configurations and sizes utilizing various numbers and types of charges. The time delay device 46 also may have various constructions with different types of components. In some applications, the time delay device 46 is in the form of time delay fuse 62 although other types of time delay devices may be utilized for a given application.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for perforating a well, comprising:

a gun string sized for deployment in a borehole drilled into a formation, the gun string having:

a perforating gun with a plurality of shaped charges oriented to form perforations into the formation upon detonation;

a chamber having at least one underbalance charge able to create a pressure underbalance in the borehole, the chamber being separate from the perforating gun along the gun string; and a time delay device coupled between the plurality of shaped charges and the at least one underbalance charge, the time delay device causing ignition of the at least one underbalance charge at a predetermined time period after detonation of the plurality of shaped charges, wherein said predetermined time period allows the borehole pressure to stabilize.

2. The system as recited in claim 1, wherein the chamber is part of a second gun.

3. The system as recited in claim 1, further comprising a casing deployed along the borehole.

4. The system as recited in claim 3, wherein the at least one underbalance charge comprises a plurality of charges sized and positioned to perforate a wall forming the chamber without perforating the casing.

5. The system as recited in claim 4, wherein the plurality of charges comprises a plurality of shaped charges.

6. The system as recited in claim 1, wherein the time delay device comprises at least one time delay fuse, the number of time delay fuses being selected according to a desired length of the predetermined time period.

7. The system as recited in claim 1, wherein the gun string comprises a packer located at an uphole position relative to the perforating gun and the chamber.

8. The system as recited in claim 1, wherein the gun string is movable along the borehole between detonation of the plurality of shaped charges and ignition of the at least one underbalance charge.

9. The system as recited in claim 3, wherein the at least one underbalance charge comprises a plurality of shaped charges sized to perforate both a wall of the chamber and the casing.

10. A method, comprising:

deploying a gun string downhole into a wellbore to a desired location along a surrounding formation;

creating perforations into the surrounding formation by detonating shaped charges of a perforating gun;

providing a time delay after detonating the shaped charges, wherein said time delay allows for the wellbore pressure to stabilize, wherein providing the time delay comprises using a time delay fuse coupled between the perforating gun and the underbalance charge; and upon completion of the time delay, igniting an underbalance charge in the wellbore to create a sufficient underbalance pressure to draw debris out of the perforations.

11. The method as recited in claim 10, wherein creating perforations comprises creating perforations through a casing and into the surrounding formation.

12. The method as recited in claim 10, further comprising locating the underbalance charge in a chamber formed by a wall pierceable upon ignition of the underbalance charge.

13. The method as recited in claim 12, wherein locating comprises locating a plurality of underbalance charges in a second perforating gun.

14. The method as recited in claim 10, further comprising moving the gun string along the wellbore between detonation of the shaped charges and ignition of the underbalance charge.

15. The method as recited in claim 10, further comprising adjusting the time delay by coupling together a corresponding number of time delay fuses.

16. A method, comprising:

detonating a plurality of shaped charges in a borehole to create perforations and to initiate a time delay fuse;

using the time delay fuse to subsequently ignite a corresponding charge, after passage of a desired period of time allowing the borehole pressure to stabilize, to cause a pressure underbalance in the borehole; and drawing debris from the perforations via the pressure underbalance to clean the perforations.

17. The method as recited in claim 16, further comprising locating the plurality of shaped charges in a first perforating gun and the corresponding charge in a second perforating gun.

18. The method as recited in claim 16, further comprising positioning the plurality of shaped charges at a location along the length of a gun string separated from the corresponding charge.

19. The method as recited in claim 18, further comprising moving the gun string along the borehole during the period of time between detonating the plurality of shaped charges and igniting the corresponding charge.

* * * * *